US006930446B1

(12) United States Patent
Moradi

(10) Patent No.: US 6,930,446 B1
(45) Date of Patent: Aug. 16, 2005

(54) METHOD FOR IMPROVING CURRENT STABILITY OF FIELD EMISSION DISPLAYS

(75) Inventor: Behnam Moradi, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 418 days.

(21) Appl. No.: 09/386,972

(22) Filed: Aug. 31, 1999

(51) Int. Cl.[7] ..... H01J 9/38
(52) U.S. Cl. ..... 313/495; 313/496; 445/5; 445/6; 445/24; 445/25; 445/42; 445/43
(58) Field of Search ..... 445/24, 25, 6, 445/40, 43, 42, 5; 313/495, 496

(56) References Cited

U.S. PATENT DOCUMENTS

| | | | | |
|---|---|---|---|---|
| 3,839,068 A | * | 10/1974 | Miura | 427/68 |
| 4,392,834 A | * | 7/1983 | Smith | 445/6 |
| 4,929,209 A | * | 5/1990 | Matsuo et al. | 445/6 |
| 5,521,461 A | * | 5/1996 | Garcia | 313/336 |
| 5,564,958 A | * | 10/1996 | Itoh et al. | 445/6 |
| 5,729,086 A | | 3/1998 | Jeong et al. | 313/495 |
| 5,788,551 A | | 8/1998 | Dynka et al. | 445/25 |
| 5,827,102 A | | 10/1998 | Watkins et al. | 445/25 |
| 6,042,441 A | * | 3/2000 | Konuma | 445/6 |
| 6,053,791 A | * | 4/2000 | Fujii et al. | 445/6 |

FOREIGN PATENT DOCUMENTS

JP 2-299129 * 12/1990

OTHER PUBLICATIONS (A translation of Sakano is included).*
Chalamala et al., "Residual Gas Effects on the Emission Characteristics of Active Mo Field-Emission Cathode Arrays,"*SID 98 Digest*, pp. 107-110 (1998).
Jüttner et al., "Stability of Field Electron Emission and Vacuum Breakdown, Investigations with Field Emission Microscopy and Auger Electron Spectroscopy,"*Phys, Stat. Sol. 27*:403-412 (1975).

* cited by examiner

*Primary Examiner*—Ashok Patel
*Assistant Examiner*—Sikha Roy
(74) *Attorney, Agent, or Firm*—Williams, Morgan & Amerson

(57) ABSTRACT

A method is provided for manufacturing a field emission device, the method including operating the field emission device in a pressure of at most about $10^{-8}$ Torr for a selected period of time to evacuate outgassed materials and sealing the field emission device.

23 Claims, 6 Drawing Sheets

METHOD FOR IMPROVING CURRENT STABILITY OF FIELD EMISSION DISPLAYS

BACKGROUND OF THE INVENTION

1. Field of the Invention

This invention relates generally to field emission displays, and, more particularly, to a method for manufacturing a field emission display.

2. Description of the Related Art

Flat panel displays have recently been developed for visually displaying information generated by computers and other electronic devices. These displays can be made lighter and require less power than conventional cathode ray tube (CRT) displays. One type of flat panel display is known as a cold cathode field emission display (FED).

A field emission display uses electron emissions to illuminate a luminescent display screen and generate a visual image. An individual field emission pixel typically includes a face plate, having the display screen formed thereon, and emitter sites formed on a base plate. The base plate includes circuitry and devices that control electron emission from the emitter sites. For example, a gate electrode structure, or grid, is associated with the emitter sites. When a voltage differential is established between the emitter sites and the grid, electron emission is initiated. The emitted electrons pass through an evacuated space and strike phosphors contained on the display screen. The phosphors are excited to a higher energy level and release photons to form an image. In this system, the display screen is the anode and the emitter sites are the cathode.

The emitter sites and face plate are spaced apart by a small distance to stand off the voltage differential and to provide a gap for gas flow. To achieve reliable display operation during electron emission, a vacuum on the order of $10^{-6}$ Torr or less is required. The vacuum is formed in a sealed space contained within the FED.

Traditionally, FEDs are constructed as a package having a seal for sealing the evacuated space between the base plate and face plate. Typically, some type of a tube must also be provided for evacuating this space ("tubulating") during construction of the FED package. The tube provides a conduit for pumping gases out of the sealed space during the evacuation of the sealed space, forming a vacuum. After the evacuation, the tube must also be sealed by pinching or by affixing a sealing member such as a plug.

One of the major problems delaying commercialization of FEDs is the lifetime problem associated with tip degradation. When electrons from tips of the emitter sites impinge on the phosphor anode display screen, certain materials are outgassed from the phosphor anode display screen. These outgassed materials then react with the tips of the emitter sites and reduce the emitted current.

A series of experiments have been run in a vacuum chamber to identify the materials outgassed from phosphor anode display screens. In particular, residual gas analyzers connected to the vacuum chamber for monitoring the materials outgassed from the phosphor anode display screens have been used. The results of the experiments indicate that carbon-based materials, including carbon dioxide ($CO_2$) and carbon monoxide (CO), are the main materials outgassed from the phosphor anode display screens. The carbon-based materials come from both the wet chemical bath, where the anode screens are processed, and the ambient. The carbon-based materials are adsorbed and/or absorbed on the tips of the emitter sites and result in a higher work function $\phi$ and, consequently, a lower emission current over time, degrading and reducing the effective lifetime of the emitter tips and the associated FEDs.

The present invention is directed to overcoming, or at least reducing the effects of, one or more of the problems set forth above.

SUMMARY OF THE INVENTION

In one aspect of the present invention, a method is provided for manufacturing a field emission device, the method including operating the field emission device in a pressure of at most about $10^{-8}$ Torr for a selected period of time to evacuate outgassed materials and sealing the field emission device.

In another aspect of the present invention, a field emission device is provided, the field emission device being formed by a method including operating the field emission device in a pressure of at most about $10^{-8}$ Torr for a selected period of time to evacuate outgassed materials through a tube before pinching off the tube to seal the field emission device.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which:

FIG. 1 schematically illustrates an embodiment of a field effect display (FED) manufactured according to the present invention; and FIGS. 2–6 schematically illustrate a flow chart for various embodiments of a method for manufacturing a FED (as shown in FIG. 1) according to the present invention.

Figure 1:
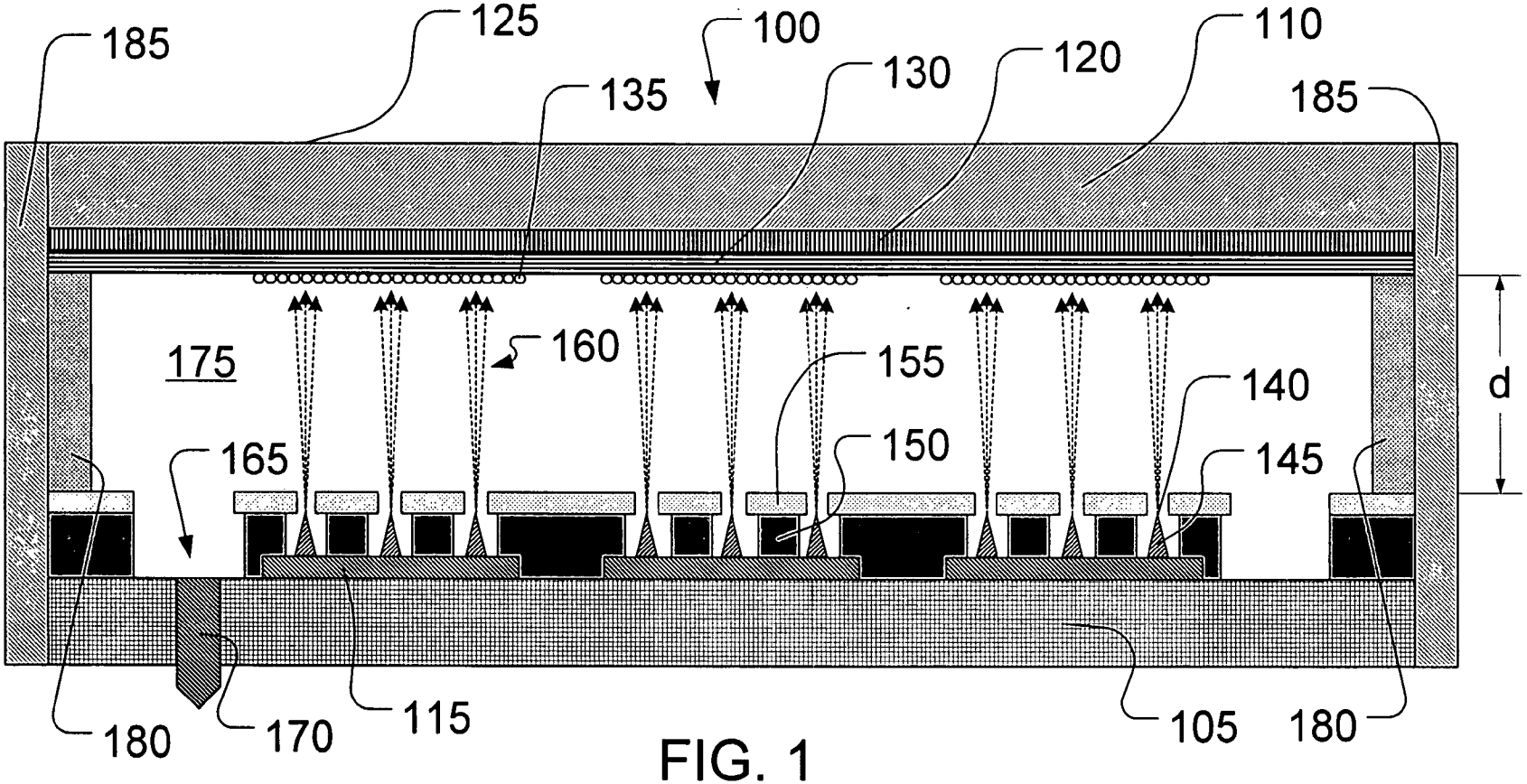
FIGS. 1–6 schematically illustrate various embodiments of a method for manufacturing according to the present invention; and, more particularly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Illustrative embodiments of a method for manufacturing according to the present invention are shown in FIGS. 1–6. As shown in FIG. 1, a field emission display (FED) 100 is schematically illustrated. The FED 100 has a base plate 105 and a face plate 110 opposite to the base plate 105. A number of cathode electrodes 115 are formed, in strips, for example, on the base plate 105. A number of anode electrodes 120 are formed, also in strips, for example, on the face plate 110. The strips of the anode electrodes 120 are disposed generally perpendicular to the strips of the cathode electrodes 115.

The anode electrodes 120 are formed on the face plate 110 on the surface opposite to a viewing surface 125, and are made of indium oxide, tin oxide, indium-tin-oxide (ITO), and the like, which are transparent, conductive materials. A fluorescent material layer 130, having phosphors 135 disposed thereon, is deposited on the anode electrodes 120. Electrons ejected from tips 140 of emitters 145 on the base plate 105 collide with the phosphors 135 in the fluorescent material layer 130 and excite electrons in the phosphors 135 into higher energy levels. As a result of the collision, light is emitted as the electrons in the phosphors 135 return to lower energy levels.

The base plate 105 is placed behind the face plate 110, away from the viewing surface 125, and is made of a semiconducting material or a ceramic or a glass. The cathode electrodes 115 formed on the base plate 105 are made of a highly doped semiconducting material such as polycrystalline silicon (poly silicon) or a conductive metal. The emitters 145 are fabricated on the cathode electrodes 115 and are made of a metal such as molybdenum (Mo), tungsten (W), platinum (Pt), and the like. The emitters 145 may also be made of a semiconducting material such as silicon or silicon coated with titanium (Ti) or titanium nitride and/or any other convenient low work function material. The shape of the emitters 145 is generally conical, and electrons are emitted from the tips 140 of the emitters 145.

The emitters 145 may be separated from one another by dielectric materials 150 and gate electrodes 155 may be deposited on the dielectric materials 150. The gate electrodes 155 control an emission current 160 emitted from the emitters 145. Also, an opening 165 for evacuation is made at a desired portion of the base plate 105 where the cathode electrodes 115 are not deposited. An evacuation tube 170 is inserted into the opening 165 for evacuation (also known as "tubulation"). Gas residing in main space 175 is pumped out through the evacuation tube 170 and through the opening 165. When an appropriate low pressure is achieved, the evacuation tube 170 is sealed off.

The face plate 110 is attached facing the base plate 105 by spacers 180, with a desired separation distance d ranging from approximately 100 to 200 $\mu$m, so that the fluorescent material layer 130 and the emitters 145 face each other and form the main space 175. The main space 175 is sealed off by firing the FED 100 assembly after coating both side edges of the face plate 110 and base plate 105 with a frit seal 185.

The spacers 180 between the face plate 110 and the base plate 105 may have the shape of a wall at each of both edges of the face plate 110 and the base plate 105, and may have a cylindrical shape in between both edges of the face plate 110 and the base plate 105. The spacers 180 may be made of dielectric materials such as glass or polyimide, and the like.

The spacers 180 should have sufficient strength to withstand the load caused by the high pressure differential that exists between external atmospheric pressure and the pressure within the evacuated main space 175. The spacers 180 should also make the spacing in the display panel even, for consistent image resolution and brightness.

Also, the cathode electrodes 115 and the anode electrodes 120 may be extended to connect to an external circuit (not shown) placed outside the main space 175.

In one illustrative embodiment of an FED 100, as described in FIG. 1, if a negative voltage and a positive voltage are respectively applied to one of the cathode electrodes 115 and a corresponding one of the anode electrodes 120 by an external circuit, an electric field is established between that cathode electrode 115 and that anode electrode 120. Electrons are emitted from each of the emitters 140 where such an electric field is formed.

Positive voltages are applied to selected ones of the gate electrodes 155 on the base plate 105 to make the emission of electrons from the corresponding emitters 145 easier. The electrons emitted from the emitters 145 are accelerated by the anode electrodes 120 and collide with the phosphors 135 of the fluorescent material layer 130. Then, the fluorescent material layer 130 emits light in the appropriate pattern for forming a picture viewable on the viewing surface 125.

The FED structure described in detail above, which is called triode-type, has conic-shaped emitters 145 made of metal, for example, and gate electrodes 155. Alternatively, a thin film diode-type FED structure is available where emitters are made of diamond thin-film and separate gate electrodes are not needed. Embodiments of the present invention may be used with a variety of FED structures since known materials that are used for FED emitters react with outgassed carbon monoxide (CO) and carbon dioxide ($CO_2$).

The outgassing problem discussed above may be eliminated and/or reduced by removing monolayers of carbon-based materials from the anode before the final seal that pinches off the tube 170 used during the tubulation process to evacuate the FED 100. This removal of the monolayers of carbon-based materials from the anode may be accomplished by operating the FED 100 under very low pressure in a vacuum chamber, for a short period of time, before the FED 100 goes through the final sealing cycle. Running the FED 100 under very low pressure removes the outgassed materials very quickly, before the outgassed materials have a chance to react with the tips 140 of the emitters 145.

An FED 100 run at a very low pressure of about $10^{-8}$ Torr in a vacuum chamber for a short period of time and then run as the chamber pressure is increased (to simulate the FED 100 package pressure) does not show observable tip degradation after running for many hours, even at high pressures. By way of contrast, conventionally manufactured FEDs running under standard conditions of about $10^{-5}$ Torr to about $10^{-6}$ Torr may show severe tip degradation after running for less than 100 hours.

Figure 2:
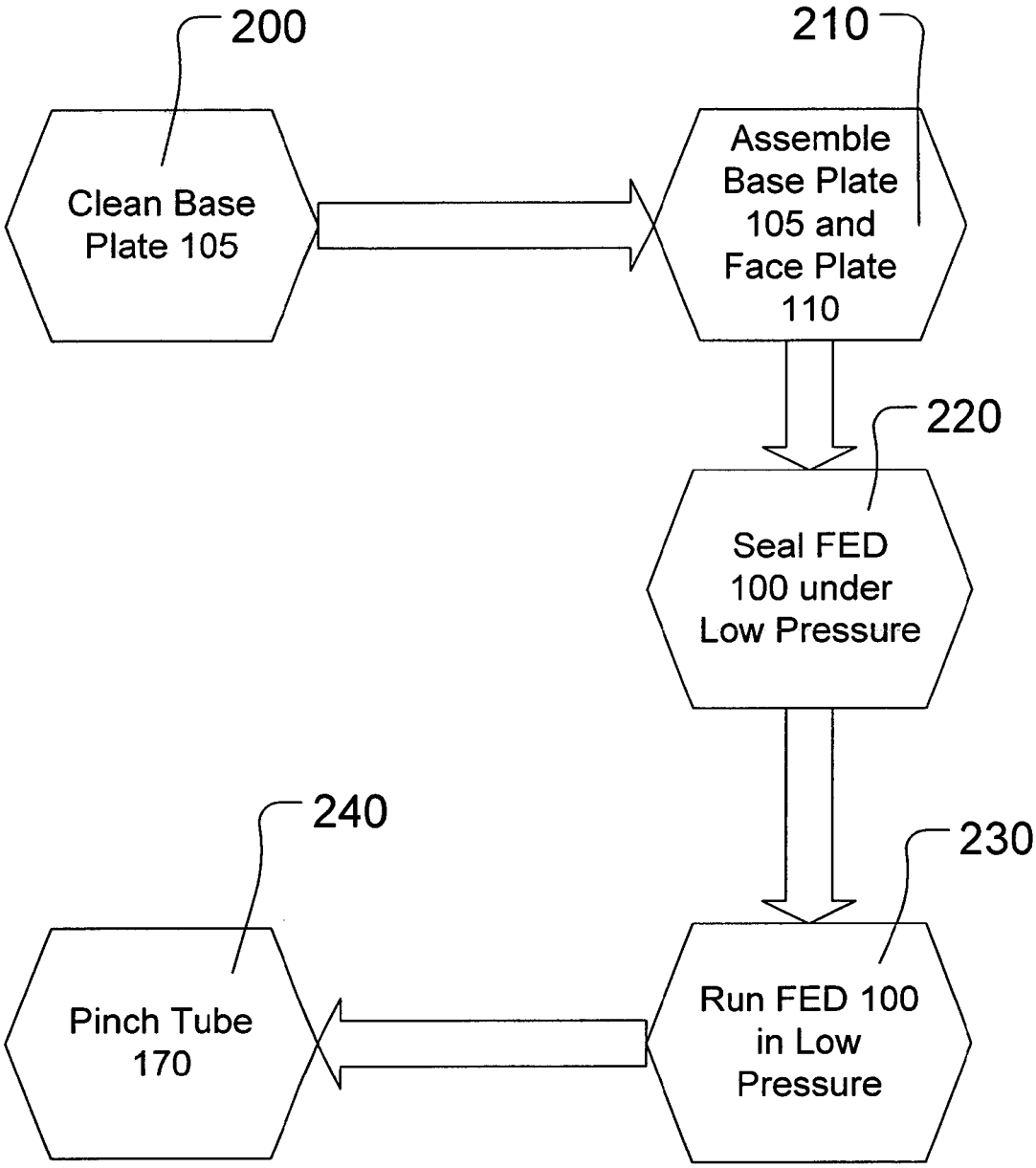

A flow chart for various illustrative embodiments of a method according to the present invention of forming the FED 100, and, more particularly, the main space 175 between the face plate 110 and the base plate 105, is schematically illustrated in FIGS. 2–6. As shown in FIG. 2, the first step 200 is to clean the base plate 105. The base plate 105 may be cleaned, for example, by using de-ionized water to remove small particles on the surface of the base plate 105.

Figure 3:
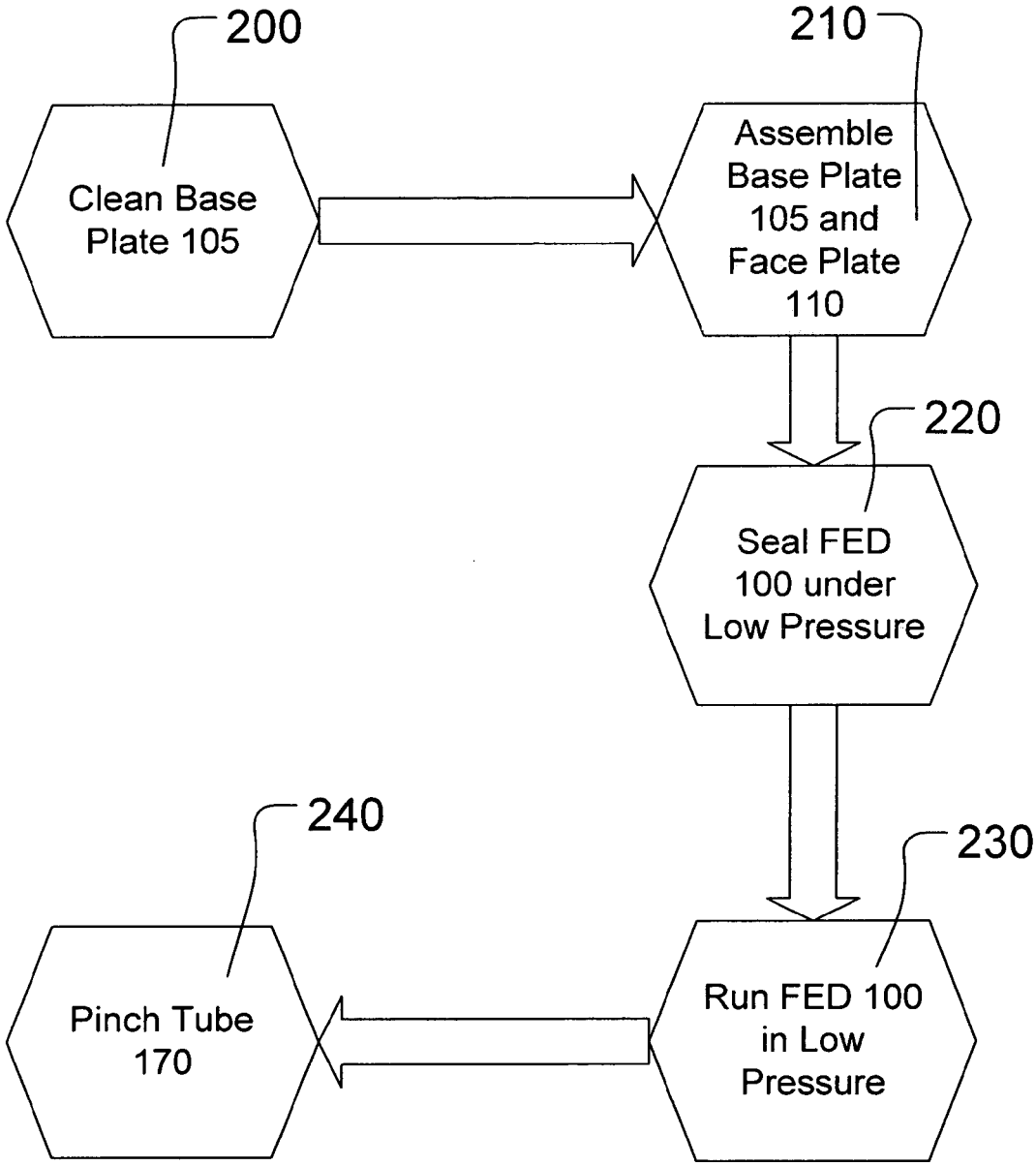

As shown in FIG. 3, the second step 210 is to assemble the base plate 105 and the face plate 110. The face plate 110 is separated from the base plate 105 by a uniform spacing, having the desired separation distance d ranging approximately from 100 to 200 $\mu$m, using the spacers 180. Both side edges of the face plate 110 and the separated base plate 105 are sealed off with a frit seal 185 applied to both the side edges. For example, frit may be dispersed around the side edges of the face plate 110 and the separated base plate 105 and assembled together with the frit seal 185 and then subjected to a heating cycle at approximately 400–450° C. for approximately 1–2 hours. During this time, the frit will be melted and thus seal the face plate 110 and the base plate 105 together with the frit seal 185. The base plate 105 should have the opening 165 for the tubulation process that uses the tube 170.

Figure 4:
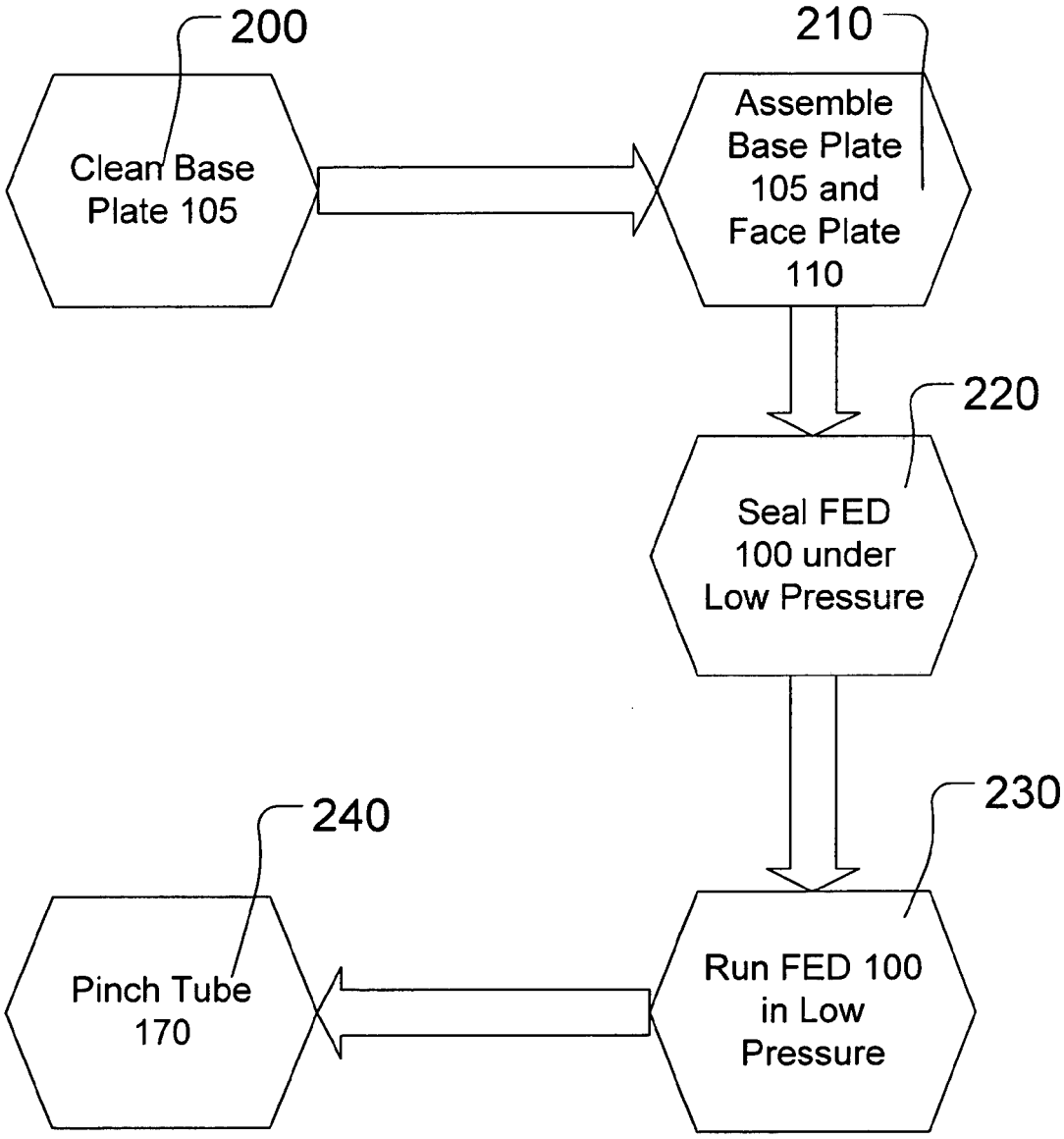

As shown in FIG. 4, the third step 220 is to seal the FED 100 package under very low pressure, in a range of approximately $10^{-7}$ Torr to $10^{-8}$ Torr. The very low pressure may be achieved by connecting the tube 170 in the opening 165 formed in the base plate 105 to a vacuum pump (not shown) and thereafter to evacuate the resident gas in the main space 175 so as to achieve a high-vacuum state.

Figure 5:
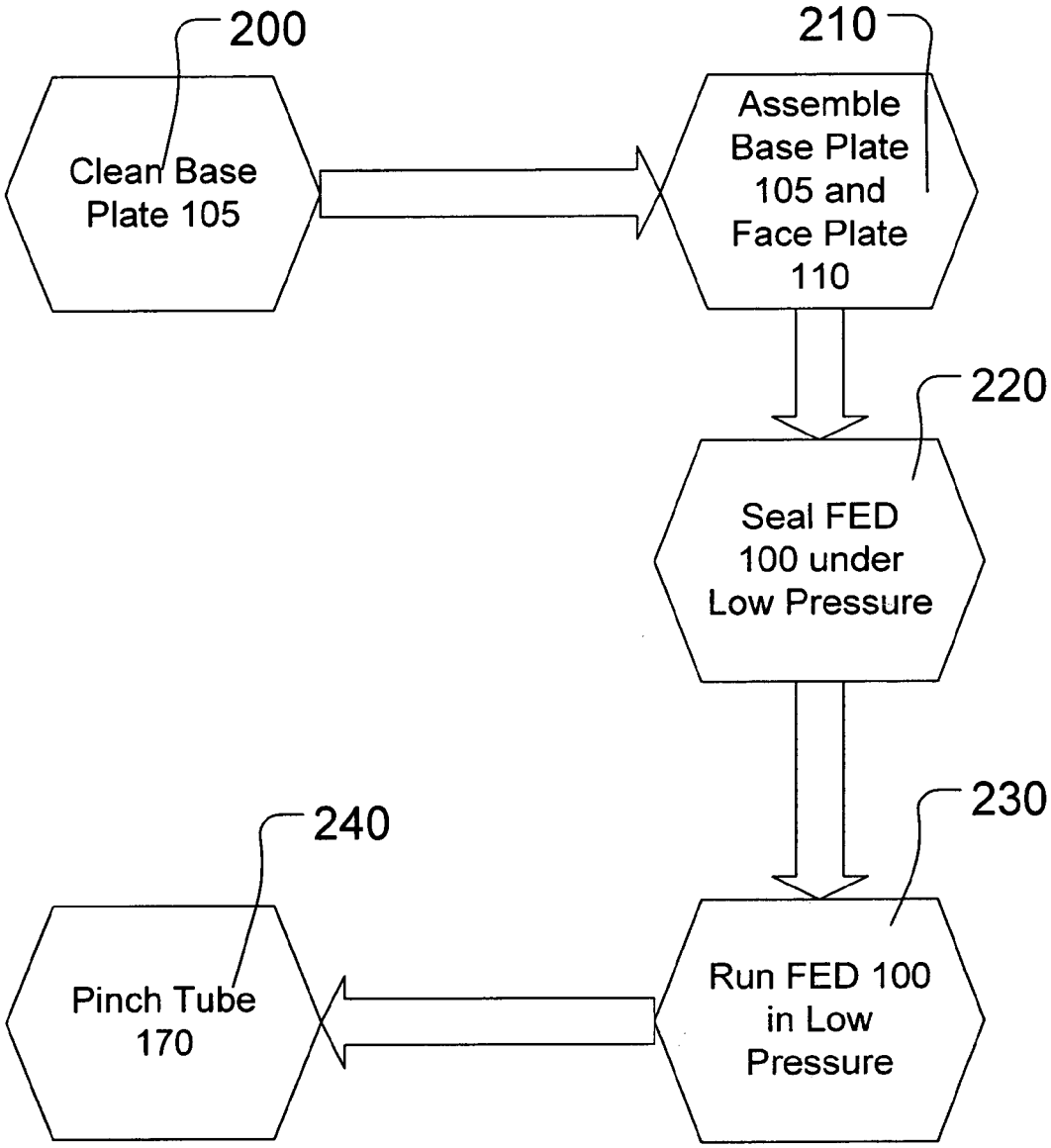

As shown in FIG. 5, the fourth step 230 is to run the FED 100 package under very low pressure, also in a range of approximately $10^{-7}$ Torr to $10^{-8}$ Torr, for a time period in a range of approximately 15–30 minutes. This fourth step 230 pumps out the outgassed materials through the tube 170 that has not already been pinched or closed off. In one illustrative embodiment, the FED 100 package is run under very low pressure, in a range of approximately $10^{-7}$ Torr to $10^{-8}$ Torr, for a time period of approximately 20 minutes.

Figure 6:
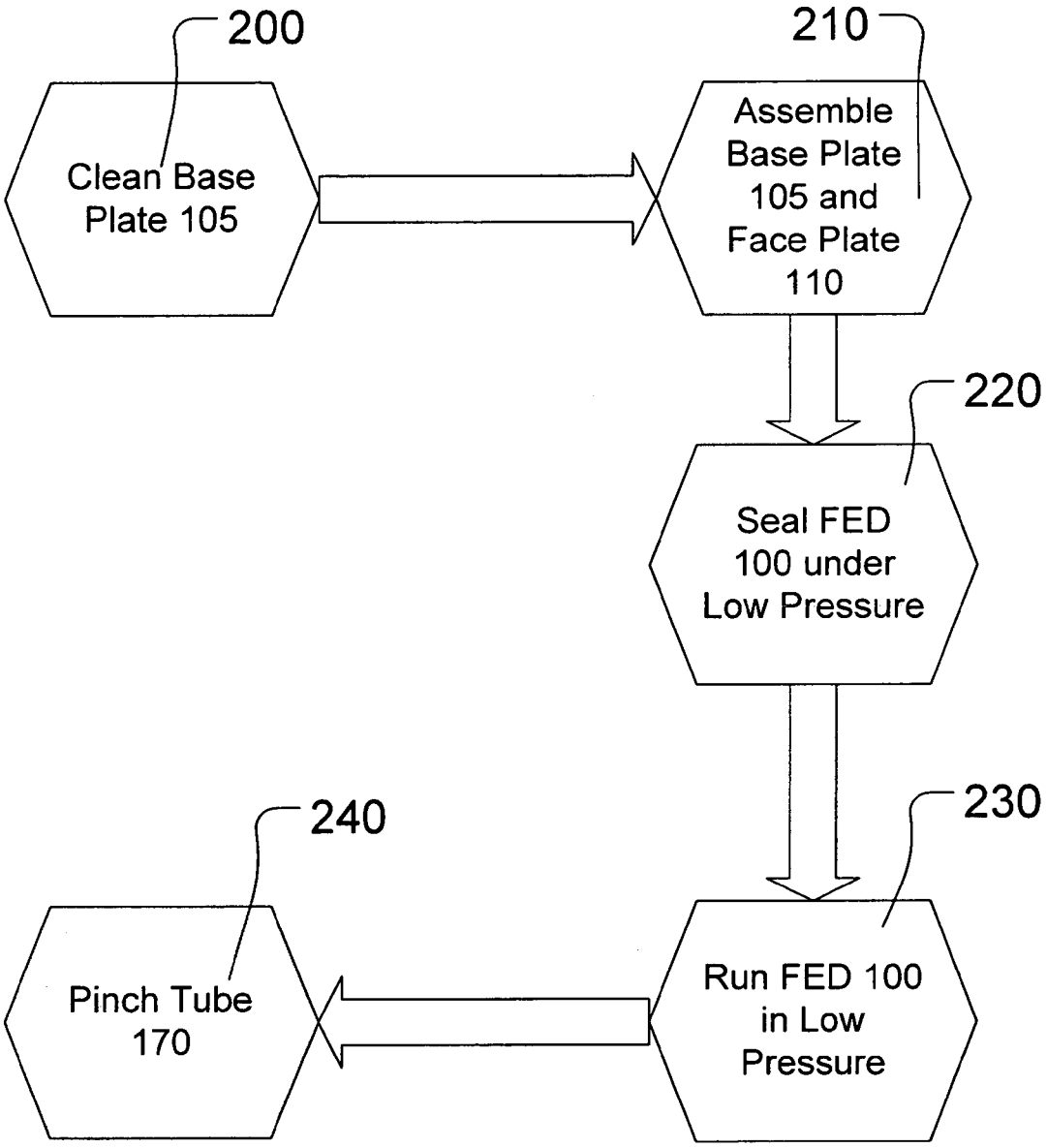

As shown in FIG. 6, the fifth step 240 is to pinch and/or close off and/or cut the evacuation tube 170, while heating and extending the evacuation tube 170 to separate the main space 175 from the vacuum pump (not shown). The pinching of the evacuation tube 170 may be performed either in the vacuum or in atmospheric pressure. The pinching of the evacuation tube 170 maintains the main space 175 in the high-vacuum state.

Any of the above-disclosed embodiments of a method of manufacturing according to the present invention enables better emission current stability and increases the lifetime of the emitter tips. Additionally, any of the above-disclosed embodiments of a method of manufacturing according to the present invention enables device fabrication with increased device integrity, precision, and efficiency, enabling a streamlined and simplified process flow, thereby decreasing the complexity and lowering the costs of the manufacturing process and increasing throughput.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of manufacturing a field emission device, the method comprising:

operating the field emission device in a pressure of at most about $10^{-8}$ Torr for at least approximately 15 minutes to remove at least a portion of materials from within said field emission device; and sealing the field emission device.

2. The method of claim 1, wherein operating the field emission device in the pressure of at most about $10^{-8}$ Torr includes operating the field emission device in a pressure of approximately $10^{-8}$ Torr.

3. The method of claim 1, wherein sealing the field emission device after the at least approximately 15 minutes includes sealing the field emission device in a vacuum chamber.

4. The method of claim 1, wherein sealing the field emission device after the at least approximately 15 minutes includes sealing the field emission device in atmospheric pressure.

5. The method of claim 1, wherein operating the sealed field emission device in a pressure of at most about $10^{-8}$ Torr for at least approximately 15 minutes includes operating the sealed field emission device in a pressure of at most about $10^{-8}$ Torr for approximately 15 to approximately 30 minutes.

6. The method of claim 1, wherein operating the sealed field emission device in a pressure of at most about $10^{-8}$ Torr for at least approximately 15 minutes includes operating the sealed field emission device in a pressure of at most about $10^{-8}$ Torr for approximately 20 minutes.

7. A method of manufacturing a field emission device, the method comprising:

cleaning a base plate of the field emission device, the base plate having an opening formed therein;

assembling the base plate with a face plate of the field emission device;

sealing the assembled base plate and face plate of the field emission device; and operating the sealed field emission device in a pressure of at most about $10^{-8}$ Tort for at least approximately 15 minutes to remove at least a portion of outgassed materials through the opening before sealing off the field emission device completely.

8. The method of claim 7, wherein operating the field emission device in the pressure of at most about $10^{-8}$ Torr includes operating the field emission device in a pressure of approximately $10^{-8}$ Torr.

9. The method of claim 7, wherein sealing off the field emission device completely includes sealing the field emission device in a vacuum chamber.

10. The method of claim 7, wherein sealing off the field emission device completely includes sealing the field emission device in atmospheric pressure.

11. The method of claim 7, wherein operating the sealed field emission device in a pressure of at most about $10^{-8}$ Torr for at least approximately 15 minutes includes operating the sealed field emission device in a pressure of at most about $10^{-8}$ Torr for approximately 15 to approximately 30 minutes.

12. The method of claim 7, wherein operating the sealed field emission device in a pressure of at most about $10^{-8}$ Torr for at least approximately 15 minutes includes operating the sealed field emission device in a pressure of at most about $10^{-8}$ Torr for approximately 20 minutes.

13. A field emission device formed by a method comprising:

operating the field emission device in a pressure of at most about $10^{-8}$ Torr for at least approximately 15 minutes to remove at least a portion of outgassed materials through a tube before pinching off the tube to seal the field emission device.

14. The device of claim 13, wherein operating the field emission device in the pressure of at most about $10^{-8}$ Torr includes operating the field emission device in a pressure of approximately $10^{-8}$ Torr.

15. The device of claim 13, wherein pinching off the tube to seal the field emission device after the at least approximately 15 minutes includes pinching off the tube in a vacuum chamber.

16. The device of claim 13, wherein pinching off the tube to seal the field emission device after the at least approximately 15 minutes includes pinching off the tube in atmospheric pressure.

17. A field emission device formed by a method comprising:

cleaning a base plate of the field emission device, the base plate having an opening for a tube;

assembling the base plate with a face plate of the field emission device;

sealing the assembled base plate and face plate of the field emission device; and operating the sealed field emission device in a pressure of at most about $10^{-8}$ Torr for at least approximately 15 minutes to remove at least a portion of outgassed materials from within said field emission device.

18. The device of claim 17, wherein operating the field emission device in the pressure of at most about $10^{-8}$ Torr includes operating the field emission device in a pressure of approximately $10^{-8}$ Torr.

19. The device of claim 17, the method further including pinching off the tube to seal off the field emission device completely after the at least approximately 15 minutes.

20. The device of claim 19, wherein pinching off the tube to seal off the field emission device completely after the at least approximately 15 minutes includes pinching off the tube in a vacuum chamber.

21. The device of claim 19, wherein pinching off the rube to seal off the field emission device completely after the at least approximately 15 minutes includes pinching off the tube in atmospheric pressure.

22. The device of claim 17, wherein operating the sealed field emission device in a pressure of at most about $10^{-8}$ Torr for at least approximately 15 minutes includes operating the sealed field emission device in a pressure of at most about $10^{-8}$ Torr for approximately 15 to approximately 30 minutes.

23. The device of claim 17, wherein operating the sealed field emission device in a pressure of at most about $10^{-8}$ Torr for at least approximately 15 minutes includes operating the sealed field emission device in a pressure of at most about $10^{-8}$ Torr for approximately 20 minutes.

* * * * *